US008757318B2

(12) United States Patent
Runciman et al.

(10) Patent No.: US 8,757,318 B2
(45) Date of Patent: Jun. 24, 2014

(54) BEHIND THE DETECTOR SOUNDER

(76) Inventors: Dunstan Walter Runciman, Capetown (ZA); David Denoon-Stevens, Bergvliet (ZA)

( * ) Notice: Subject to any disclaimer, the term of this patent is extended or adjusted under 35 U.S.C. 154(b) by 25 days.

(21) Appl. No.: 13/583,469

(22) PCT Filed: Mar. 9, 2011

(86) PCT No.: PCT/US2011/027718

§ 371 (c)(1),
(2), (4) Date: Feb. 21, 2013

(87) PCT Pub. No.: WO2011/112698

PCT Pub. Date: Sep. 15, 2011

(65) Prior Publication Data

US 2013/0146390 A1 Jun. 13, 2013

(30) Foreign Application Priority Data

Mar. 9, 2010 (GB) ..... 1003884.2

(51) Int. Cl.
*G10K 11/00* (2006.01)

(52) U.S. Cl.
USPC ..... 181/188; 181/175; 181/176; 181/193; 181/187

(58) Field of Classification Search
USPC ..... 181/193, 188, 187, 176, 175
See application file for complete search history.

(56) References Cited

U.S. PATENT DOCUMENTS

| | | | | |
|---|---|---|---|---|
| 2,550,359 | A * | 4/1951 | Levy | 181/187 |
| 2,869,668 | A * | 1/1959 | Levy | 181/188 |
| 4,893,343 | A | 1/1990 | Bader | |
| 5,969,627 | A | 10/1999 | Tarlton et al. | |
| 6,362,726 | B1 | 3/2002 | Chapman | |
| 8,479,874 | B2 * | 7/2013 | Moreton Cesteros | 181/199 |

FOREIGN PATENT DOCUMENTS

| | | |
|---|---|---|
| CN | 1707608 A | 12/2005 |
| EP | 1881470 | 1/2008 |
| JP | 2005141079 A | 6/2005 |

* cited by examiner

*Primary Examiner* — Forrest M Phillips
(74) *Attorney, Agent, or Firm* — Cantor Colburn LLP

(57) ABSTRACT

A behind the detector sounder has a base plate and walls which define mechanical horns having throats which open into a space at the centre of the base plate. The mouths of the mechanical horns are at the outer periphery of the base plate and the walls bound sound paths which are longer than the straight line distance from the throat of each mechanical horn to the mouth of that mechanical horn.

8 Claims, 6 Drawing Sheets

BEHIND THE DETECTOR SOUNDER

CROSS-REFERENCE TO RELATED APPLICATIONS

This application claims the benefit of, and is the U.S. national stage of International Application No. PCT/US2011/027718 filed on 9 Mar. 2011, which claims the priority benefit of British (GB) Application No. 10038842 filed on 9 Mar. 2010, the disclosures of which are incorporated by reference herein in their entirety.

FIELD OF THE INVENTION

This invention relates to sounders and in particular to "behind the detector" sounders.

BACKGROUND TO THE INVENTION

Sounders for use in fire alarm systems fall into two categories. The first category comprises standalone sounders as exemplified, for example, by the sounder of U.S. Pat. No. 6,905,001. In this form the sounder can be fitted to a ceiling or a wall. The second category comprises "behind the detector" sounders. In this form a base is fitted to the ceiling, the sounder is fitted to the base, and then the detector is fitted to the sounder. It is an essential requirement that the dimension of the stack of base, sounder and detector, measured vertically, be kept as small as possible. The diameter of the sounder has to be compatible with that of the base and detector.

This creates difficulties in designing a sounder which will produce not only the requisite volume of sound but also a sound distribution pattern which meets the demands of the specifications which the authorities in most industrialised countries have established. Another factor which complicates the construction of sounders of this type is that the power available to vibrate the diaphragm which produces the initial sound waves is low.

One of the components of a known "behind the detector" sounder is illustrated in the Figure designated "prior art".

The sounder component is designated 1 and comprises a base wall 2 and a skirt 3. the sound paths, which extend radially, are designated 4 and are bounded by walls 5 which protrude upwardly from the base wall 1. The throats 6 of the sound paths are at the centre of the base wall 2 and their mouths 7 are at the periphery of the base wall 2. The spaces 8 within adjacent walls 5 receive the electrical components which connect the ceiling mounted base (not shown) to the electronics of the "behind the detector" sounder. The base closes the sound paths 4.

Columns 9 are provided for mechanically connecting the sounder component to the base.

The parameters which have to be taken into consideration in designing a horn are throat area, mouth area, the rate at which the horn flares from throat to mouth and the length of the horn from throat to mouth.

The freedom of the designer to vary the first three parameters is limited by various factors such as physical size, the cut-off frequency and the optimal load impedance. The fact that speech must be transmitted also increases the difficulties involved in designing a "behind the detector" sounder.

This leaves the designer with the length of the horn as the dimension which he can most readily vary to obtain a sounder having the desired characteristics.

The present invention seeks to provide a "behind the detector" sounder which has acceptable dimensions and which also provides sound of sufficient volume and with a distribution pattern that meets the applicable industry standards of the major industrial countries.

BRIEF SUMMARY OF THE INVENTION

According to the present invention there is provided a behind the detector sounder which comprises a base plate and walls upstanding from the base plate, the walls defining a plurality of mechanical horns having throats which open into a space at the centre of the base plate, the mouths of the mechanical horns being at the outer periphery of the base plate, said walls bounding sound paths which are longer than the straight line distance from the throat of each mechanical horn to the mouth of that mechanical horn.

In a first form said walls define sound paths which have two reflex bends therein. More specifically, in this form, each sound path extends generally radially outwardly from its throat to a first reflex bend, then generally radially inwardly to a second reflex bend, and then again generally radially outwardly to said mouth.

In another form each sound path is of spiral form and extends from the throat through one or more turns to the mouth thereof.

Lights can be provided between the mouths of adjacent mechanical horns.

The sounder can have three or six sound paths.

BRIEF DESCRIPTION OF THE DRAWINGS

For a better understanding of the present invention, and to show how the same may be carried into effect, reference will now be made by way of example to the accompanying drawings in which.

DETAILED DESCRIPTION OF THE DRAWINGS

Figure 1:
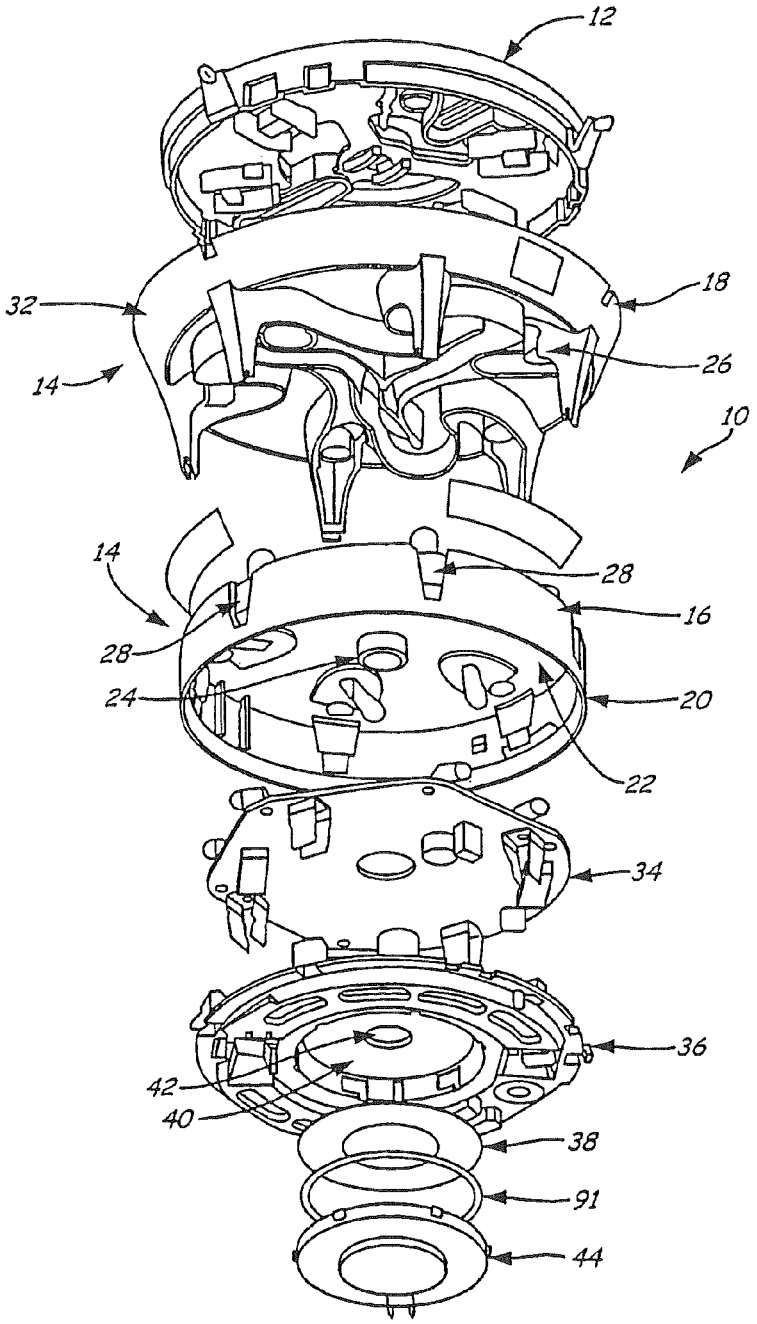
FIG. 1 is an "exploded view" illustrating the way in which a "behind the detector" sounder is incorporated into a ceiling mounted fire detector.

Referring firstly to FIG. 1, the structure 10 illustrated comprises a base 12 which is fitted to the ceiling. A sounder is shown at 14. The sounder 14 is constituted by two parts designated 16 and 18. The part 18 includes an outer sleeve 20 and a disc-like transverse wall 22. The transverse wall 22 has a central opening 24 in it.

The part 18 includes columns 26 which fit into grooves 28 in the part 16 thereby to locate the parts 16 and 18 with respect to one another. Screws (not shown) secure the two parts together. The part 18 includes a base wall 30 (see FIGS. 2 to 7) and a skirt 32 and will be described in detail hereinafter with reference to FIGS. 2 to 7. The skirt 20 of the part 16 receives a printed circuit board 34 which carries the electronics of the sounder. The board 34 is held in place by a cover 36. A diaphragm, preferably a piezoelectric diaphragm, is shown at 38 and this fits into a central cavity 40 of the cover 36. The cavity 40 has a central opening 42. A ring 44 holds the diaphragm 38 in the cavity 40. The base wall 30 of the sounder includes a cone 46 which points towards the diaphragm 38.

The cone directs the sound waves resulting from vibration of the diaphragm 38 into the throats of the mechanical horns of the sounder 14 as will be described.

Whilst a diaphragm is illustrated any other form of sound generator can be used. A carbon fibre diaphragm can also be used.

The detector proper fits into the skirt 20 of the sounder 10 below the cover 36. The detector can be a smoke detector, a heat detector or any other conventional form of fire detector.

Figure 2:
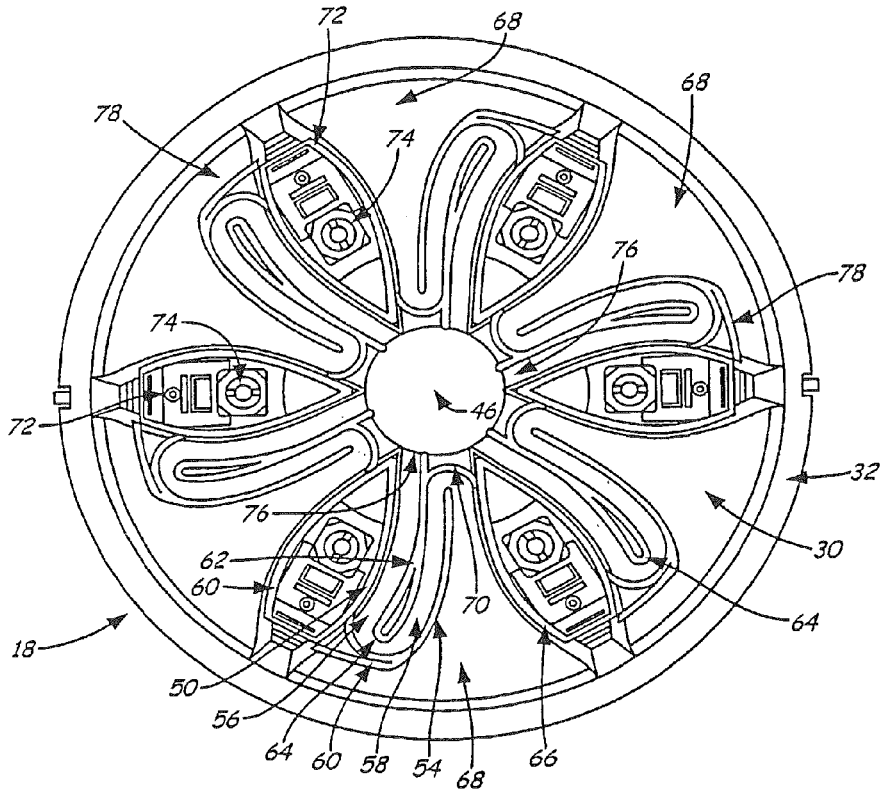
FIG. 2 is a plan view of the base part of a sounder.
Figure 3:
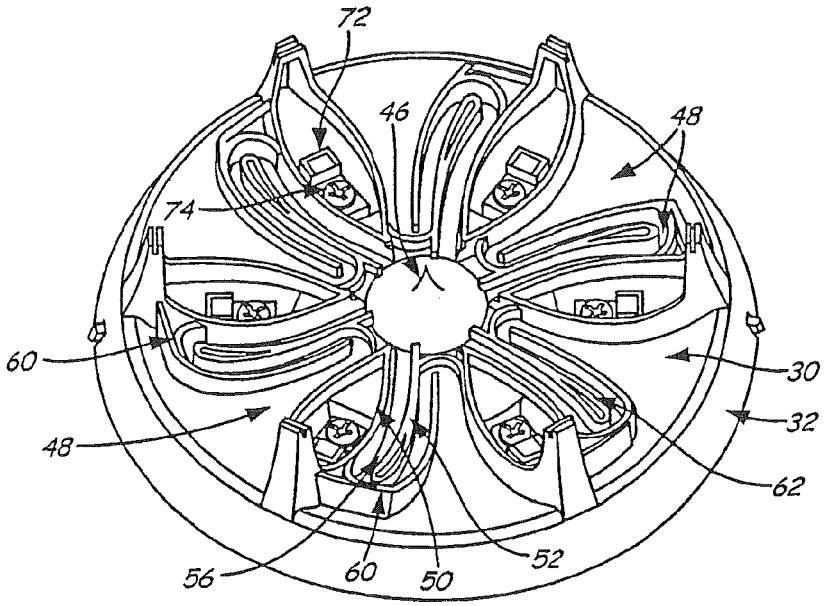
FIG. 3 is a pictorial view of the base part sounder of FIG. 2.

Turning now to FIGS. 2 and 3, the sounder 14 illustrated includes a plurality of sound paths designated 48. Each sound path is bounded by generally parallel, generally radially extending walls 50, 52 and 54. The walls 50 and 52 define a first generally radially extending section 56 of the sound path 48 and the walls 52 and 54 define a second generally radially extending sound path section 58. The sections 56 and 58 of each sound path 48 are separated by the wall 52.

The wall 54 curves around at 60 to join the wall 50. The wall 52 splits at 62 thereby to provide a rounded end surface 64 which faces the curved wall 60. A first reflex bend consequently joins the sections 56 and 58. The wall 54 and a further wall 66 form a cone-shaped mouth 68. The mouth 68 is joined to the second sound path section 58. Specifically, a curved wall 70 joins the walls 52 and 66, the wall 54 terminating at a position spaced from the wall 70. Thus a second reflex bend is provided between the section 56 and the mouth 68.

The structure described provides six mechanical horns each of which has two reflex bends in it. The transverse wall 22 of the part 16 closes-off the sound paths 48. The walls which bound the sound paths increase in height from the throats to the mouth. Hence the horns flare not only in the direction of the plane of the base 30 but also in the direction at right angles to it. The horns consequently increase in area from their throats to their mouths.

The walls 50 and 66 define spaces 72 which contain electrical connections 74 which place the base 12 in electrical contact with the electronics of the board 34.

The lengths of the sound path from the throats designated 76 to the mouths 68 is sufficient to amplify the sound emitted by the diaphragm 40 to a level which meets both the volume and distribution pattern requirements.

Strobe lights, for example in the form of light emitting diodes, are provided in the space bounded by the walls 50 and 60 and are covered by a Fresnel glass 78.

Figure 4:
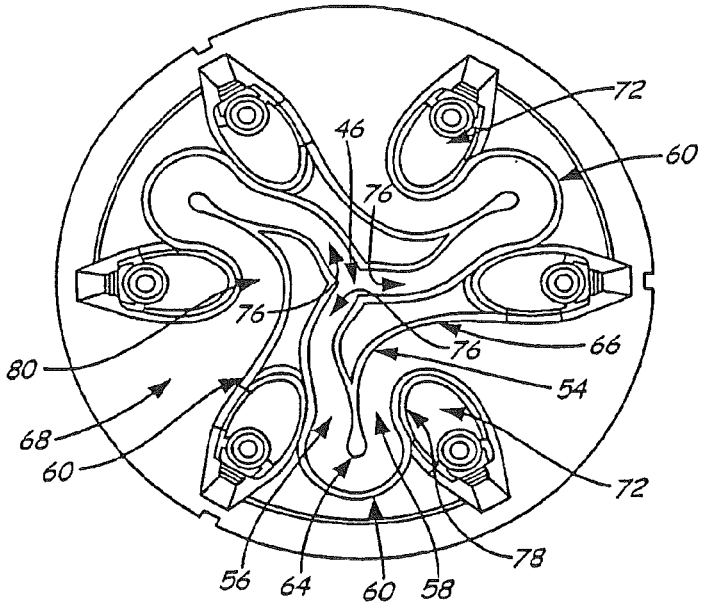
FIG. 4 is a plan view of the base part of a further sounder.
Figure 5:
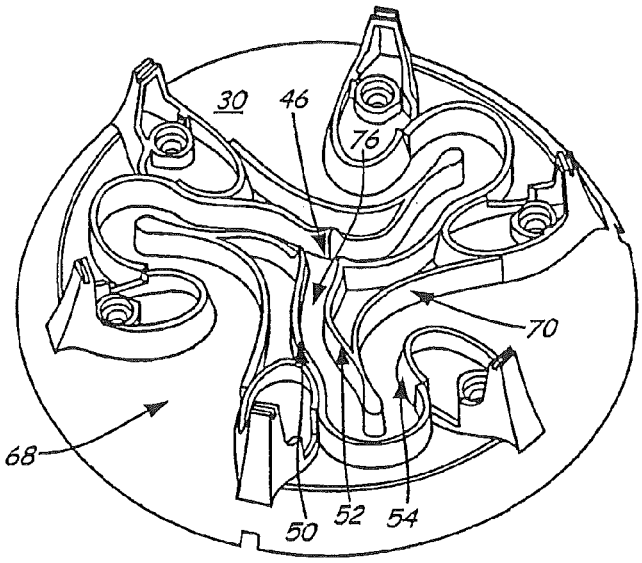
FIG. 5 is a pictorial view of the base part of FIG. 4.

The sounder of FIGS. 4 and 5 differs from that of FIGS. 2 and 3 in that only three, and not six, mechanical horns are provided. When applicable like references have been used to designate like parts. In the sounder of FIGS. 4 and 5, the walls 50 join the wall sections 60 which themselves merge with walls 80 which bound the spaces 72. The walls 54 merge with the walls 66.

Figure 6:
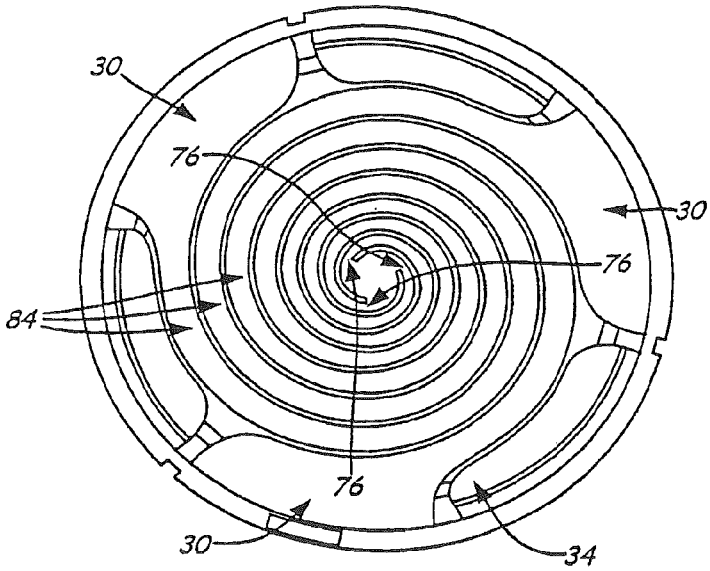
FIG. 6 is a plan view of the base part of another sounder.

The sounder of FIGS. 4 and 6 has a reflex bend between the sections 56 and 58 and a further bend, designated 82, between the section 58 and the mouth 68.

Figure 7:
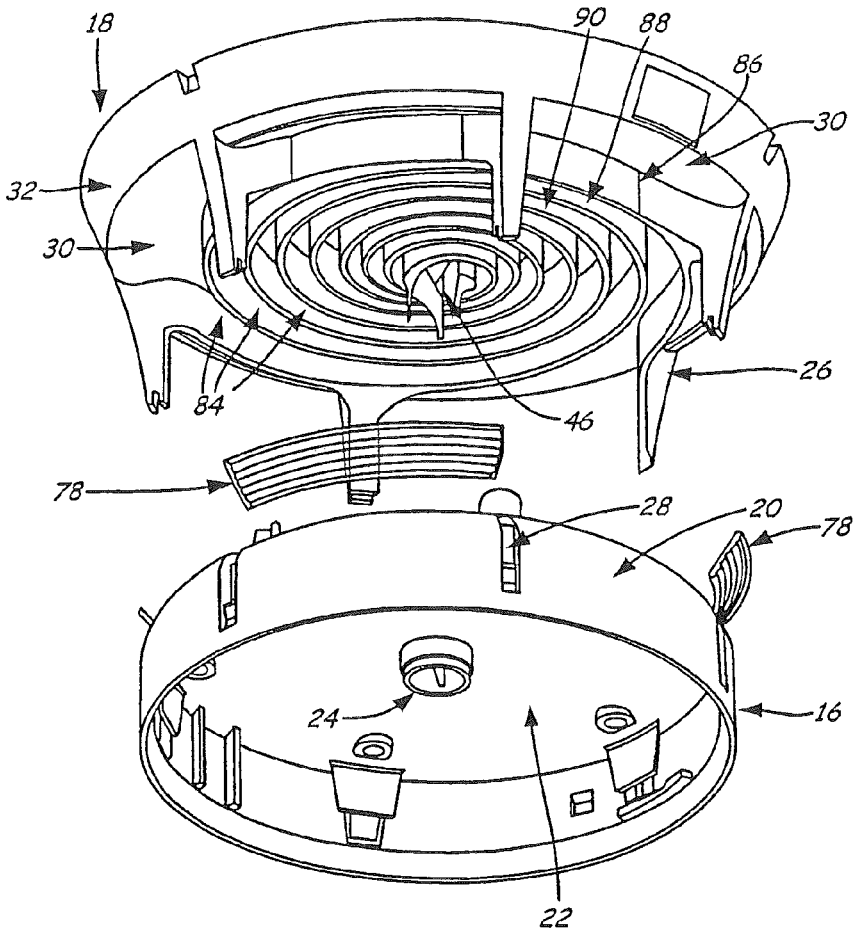
FIG. 7 is a pictorial view of the two parts of the sounder of FIG. 6.
Figure 8:
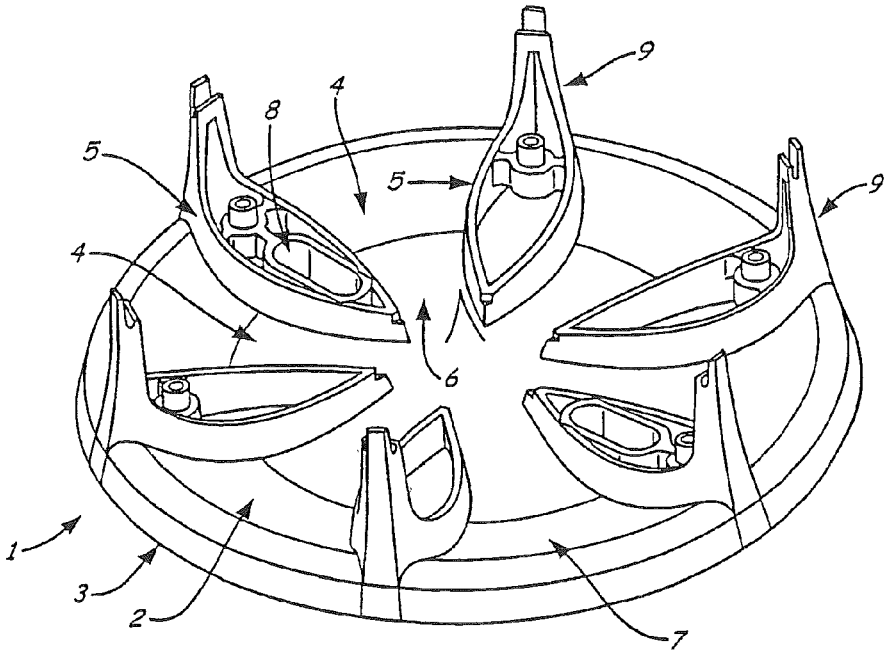
Prior Art Fig. 8
FIG. 8 depicts a conventional sounder.

The sounder of FIGS. 6 and 7 has many parts in common with the sounders of FIGS. 1 to 5 and again like parts have been designated with like reference numerals. This sounder has three spiral sound paths 84, these being separated from one another by spiral walls designated 86, 88 and 90. The walls 86, 88 and 90 protrude from the base wall 30 in the same way as do the walls 50, 52, 54, 60, 66 and 70.

The invention claimed is:

1. A behind the detector sounder which comprises a base plate and walls upstanding from the base plate, the walls defining a plurality of mechanical horns having throats which open into a space at the centre of the base plate and having mouths, the mouths of the mechanical horns being at the outer periphery of the base plate, said walls bounding sound paths which are longer than a straight line distance from the throat of each mechanical horn to the mouth of that mechanical horn.

2. A sounder as claimed in claim 1, wherein said walls define sound paths which have two reflex bends therein.

3. A sounder as claimed in claim 2, wherein each sound path extends generally radially outwardly from its throat to a first reflex bend, then generally radially inwardly to a second reflex bend, and then again generally radially outwardly to said mouth.

4. A sounder as claimed in claim 1, wherein each sound path is of spiral form and extends from the throat through one or more turns to the mouth thereof.

5. A sounder as claimed in claim 1, wherein lights are provided between the mouths of adjacent mechanical horns.

6. A sounder as claimed in claim 2, and which has three or six sound paths.

7. A sounder as claimed in claim 4, and which has three sound paths.

8. A sounder as claimed in claim 1, wherein the plurality of mechanical horns define one of a group consisting of three sound paths and six sound paths.

* * * * *